US006164464A

United States Patent [19]

Auke

[11] Patent Number: 6,164,464

[45] Date of Patent: Dec. 26, 2000

[54] DEVICE FOR SUPPORTING OBJECTS

[76] Inventor: Trond Auke, Vågebyveien 11, N-1312 Slependen, Norway

[21] Appl. No.: 09/254,389

[22] PCT Filed: Sep. 3, 1997

[86] PCT No.: PCT/NO97/00231

§ 371 Date: Jul. 15, 1999

§ 102(e) Date: Jul. 15, 1999

[87] PCT Pub. No.: WO98/10411

PCT Pub. Date: Mar. 12, 1998

[30] Foreign Application Priority Data

Sep. 6, 1996 [NO] Norway ..... 963740

[51] Int. Cl.[7] ..... A47F 7/00

[52] U.S. Cl. ..... 211/85.6; 211/96; 248/315; 84/387 A

[58] Field of Search ..... 84/327, 329, 400, 84/387 A; 211/96, 85.6, 81, 168; 248/315

[56] References Cited

U.S. PATENT DOCUMENTS 169,962 11/1875 Cross .
610,249 9/1898 Skilton .
1,045,583 11/1912 Mills .
1,777,823 10/1930 Bernard .
1,975,303 10/1934 Walker et al. .
2,591,041 4/1952 Berg .
4,611,722 9/1986 Teig .
4,759,252 7/1988 Occhipinti .

FOREIGN PATENT DOCUMENTS 173798 3/1993 Norway .

*Primary Examiner*—Robert W. Gibson, Jr.
*Attorney, Agent, or Firm*—Volpe and Koenig, P.C.

[57] ABSTRACT

The present invention relates to a device for supporting articles, and for the purpose of providing a device which is simple to use, requires small space during transport and can be manufactured from simple elements, it is according to the invention suggested that it comprises a plurality of thin, plate-shaped elements (2*a*–2*c*) having a common pivoting zone (3) for in a first gathered position to constitute superjacent layers (FIG. 2) and in a second, unfolded position (FIG. 1) to constitute a plurality of article supporting elements (2*a*–2*c*), and that the device (1) in the area of the pivoting zone (3) comprises an attachment means (4).

20 Claims, 2 Drawing Sheets

DEVICE FOR SUPPORTING OBJECTS

FIELD OF THE INVENTION

The present invention relates to a device for supporting articles.

BACKGROUND OF THE INVENTION

The present invention has been developed especially in connection with musical instruments, and more specifically in connection with mute holders for brass instruments.

It is to be understood that the present device also can be used in other connections wherein there is a need for a device for supporting one or more articles, at the same time as the device when not being used should occupy a small space for simplified transportation together with equipment with which it is to be used.

SUMMARY OF THE INVENTION

According to the invention there is suggested a device for supporting articles, which is characterized in that it comprises a plurality of thin, plate-shaped elements having a common pivoting zone for in a first gathered position to constitute superjacent layers and in a second, unfolded position to constitute a plurality of article supporting elements, and that the device in the area of the pivoting zone comprises an attachment means.

Further features and advantages of the present invention will appear from the following description taken in conjunction with the appending drawings, as well as from the appending patent claims.

BRIEF DISCLOSURE OF THE DRAWINGS

DETAILED DESCRIPTION OF EMBODIMENT

Figure 1:
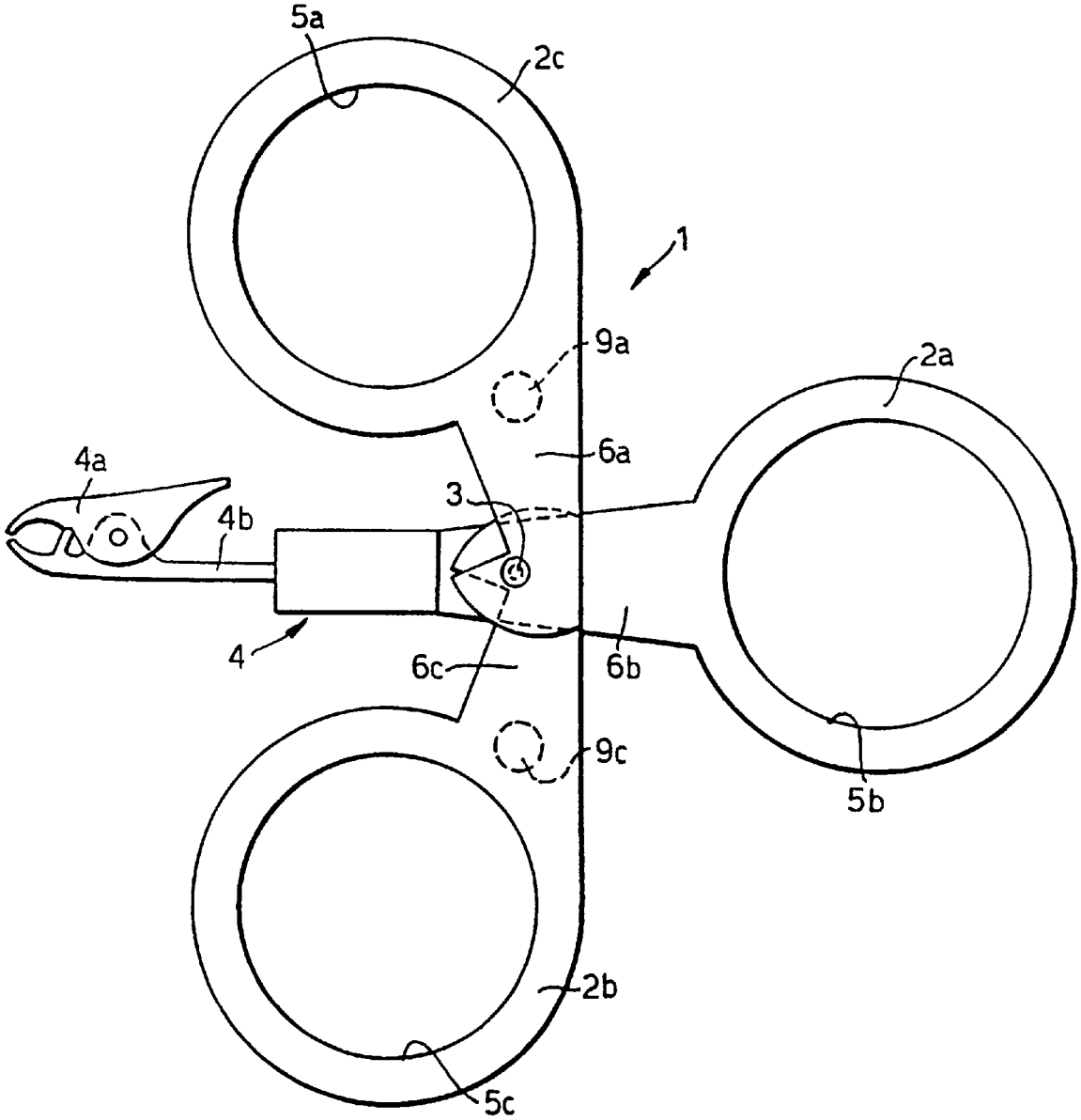
FIG. 1 is a top view illustrating an embodiment of a device according to the invention, comprising three pivotable elements and illustrated in a spread out user position.
Figure 2:
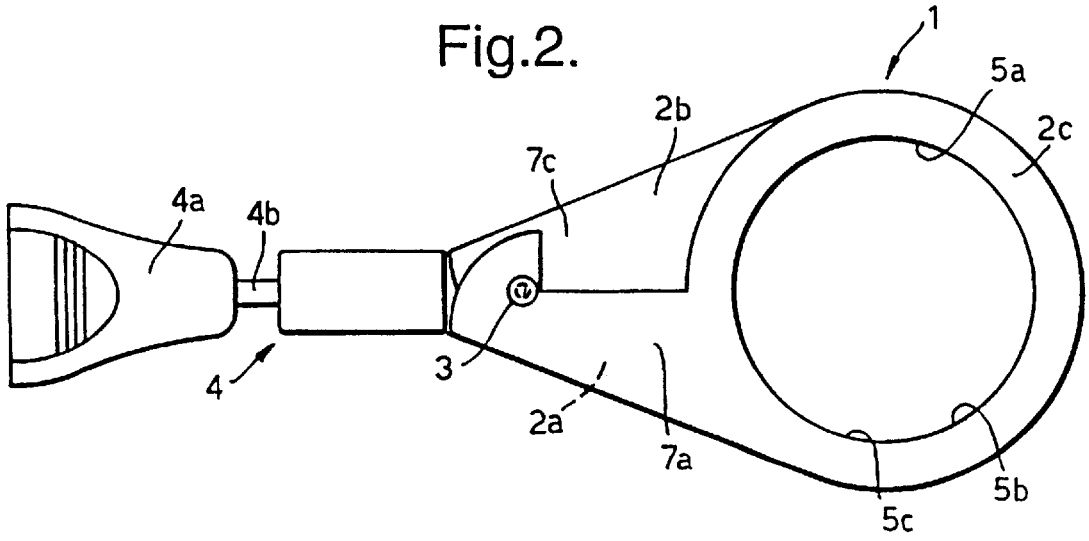
FIG. 2 is a plan view similarly to FIG. 1 and illustrates said embodiment wherein the three elements have been gathered, and wherein the associated attachment means has been pivoted 90°.
Figure 3:
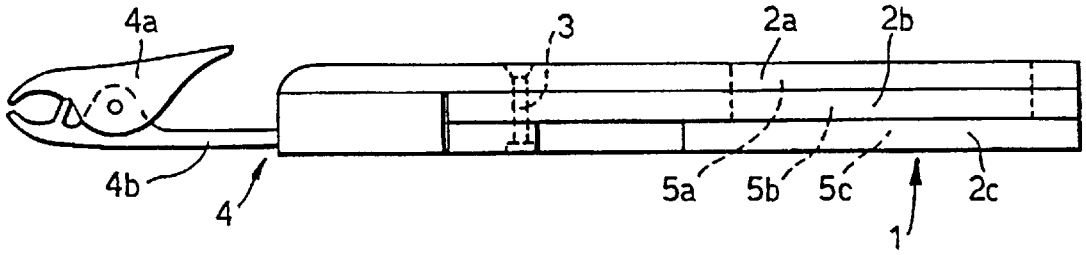
FIG. 3 is a side view of the embodiment illustrated in FIG. 2 and illustrates here the three elements as subjacent layers.

In FIGS. 1, 2 and 3 there is illustrated an embodiment of a device 1 for supporting articles, which embodiment is based upon the principle of comprising a plurality of thin, plate-shaped elements, here for example three elements 2*a*, 2*b* and 2*c*, respectively, having a common pivoting zone 3. This involves that the device can take a first gathered position as this is illustrated in FIGS. 2 and 3, said individual elements 2*a*, 2*b* and 2*c* then constituting layers arranged on top of each other, whereas in a second, spread out or unfolded position, as this is illustrated in FIG. 1, said elements 2*a*, 2*b* and 2*c* will then constitute a plurality of article supporting elements.

As illustrated in FIGS. 1–3 the device 1 also comprised an attachment means which is generally illustrated by reference numeral 4, and which may have different forms and properties depending on the base to which the device 1 is to be attached.

It is to be understood that each of the plate-shaped elements can be provided with at least one holding means, for example a recess for inserting articles having appropriately varying breadth.

In the embodiment illustrated in FIGS. 1–3 the plate-shaped elements 2*a*, 2*b* and 2*c* are provided with at least one substantially circular recess 5*a*, 5*b* and 5*c*, respectively, for the support of articles having for example inclined outer wall portions, for example cups, mutes or similar.

Further, it is to be understood that the plate-shaped elements can be provided with one or more recesses having various dimensions for the support of one or more articles of various size, for example mouthpiece and mute.

In the embodiment according to FIGS. 1–3 the three plate-shaped elements 2*a*–2*c* are provided with a narrow neck portion 6*a*, 6*b* and 6*c*, respectively, in the area of the pivoting zone 3, said neck portion of all three elements on the one hand being expanded to a round portion 2*a*–2*c* which with appropriate recesses 5*a*–5*c* are adapted to support an article, and said neck portions, on the other hand, being appropriately connected with said attachment means 4, for example as illustrated by detail A in FIG. 3.

Further, in FIG. 1 and FIG. 2 it is illustrated that the upper element 2*a* and the lower element 2*c* are provided with a neck portion 6*a* and 6*c*, respectively, which on opposite sides are overlapped by oppositely protruding flaps 7*a* and 7*c*, respectively, which flaps when being influenced by the user and when said elements are provided in the first collected position, see FIG. 2, and then as subjacently arranged layers, will serve in spreading the elements or rings 2*a* and 2*c* somewhat apart for facilitating the final spreading to the user position as illustrated in FIG. 1.

Figure 4:
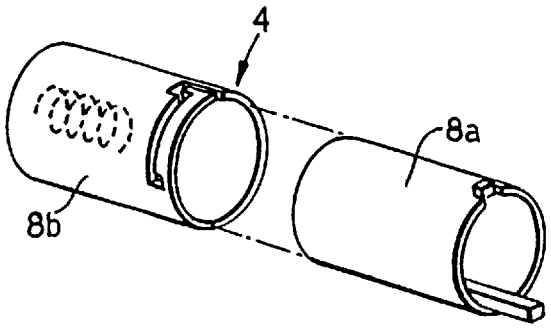
FIG. 4 illustrates on a larger scale detail A of FIG. 3, namely an embodiment of the attachment means, which embodiment allows for both pivoting of the attachment means and a replacement thereof.

In the detail as appearing from FIG. 4 it can be seen that the attachment means 4 is arranged pivotable, and with sleeves 8*a* and 8*b*, respectively, which are mutually pivotable, which sleeves allow for pivoting to a fixed position in one or more pivot positions for setting the device in various angular positions, respectively adapt the attachment means in relation to the attachment base, which might be for example a stand, and more specifically a music stand.

From FIG. 4 it also appears that the pivotable means 4 can be arranged detachable for adaption to an attachment base having various shape and size, for example a stand having a round or square attachment area, and more specifically an edge portion of a base in the proximity of a user.

In the embodiment illustrated in FIGS. 1–4 it can be said that the device 1 comprises two main bodies, namely the attachment element 4, which for example is adapted to be attached to a music stand. It is to be understood that two types of clips can be contemplated, for example a clip for round and another clip for square stands. From the clip 4*a* itself on the attachment means there extends a rod 4*b* which terminates in an end piece, for example a piston-shaped head.

The second main body comprises the three elements, here provided as three rings having for example a 7 cm long arm or neck portion. The rings have been arranged on top of each other and are attached to each other at the end of the respective arm. These rings can be folded out so as to form a triangle.

In the end of the arms or the neck portions there are provided a cylinder comprising a spring and a track, see FIG. 4. When the parts are put together it will be possible to pivot the parts for example 45° in relation to each other, and due to the spring loading the parts will lock in position ready for use.

In the embodiment illustrated in FIGS. 1–4 there may additionally be provided openings in said neck portions, see for example reference numerals 9*a* and 9*c*, for example for the insertion of mouthpieces.

The device 1 according to the invention can thus be transported in the position as illustrated in FIG. 2, and during use the following operations can be effected:

attach the clip 4*a* to the stand and pivot the rings 2*a*–2*c* to the left one click attaches/locks the rings in position pressing together at the neck portions of the rings for the spreading of the rings upon foldaway, push inwardly and twist to the right, whereafter the clip is released.

What is claimed is:

1. A device for supporting articles, comprising a plurality of thin, plate-shaped elements (2*a*–2*c*) having a common pivoting zone (3) for selective rotation between a first gathered position which constitutes superjacent layers (FIG. 2) and a second, unfolded position (FIG. 1) which constitutes a plurality of article supporting elements (2*a*–2*c*), characterized in that the thin, plate-shaped elements (2*a*–2*c*) are provided with flat surfaces and are permanently attached at said common pivoting zone (3), and that the device comprises an attachment means (4) which can be pivoted relative the pivoting zone (3) and is pivotable and provided with means (8*a*–8*b*) for fixing its position in at least one selected position, for setting the device (1) in various angular positions, with respect to an attachment base.

2. The device as stated in claim 1, characterized in that it is provided with three flat plate-shaped elements (2*a*–2*c*), each being provided with a narrow neck portion (7*a*–7*c*) in the area of the pivoting zone (3), a first end of said neck portion (7*a*–7*c*) on each of the three elements extends to a supporting means (5*a*–5*c*) which is adapted to support an article, and a second end of said neck portion (7*a*–7*c*) being appropriately connected with the attachment means (4).

3. The device as claimed in claim 1, characterized in that the uppermost (2*a*) and the lowermost (2*c*) elements are each provided with a neck portion (7*a*–7*c*) which has, at an end proximate the pivoting zone, a protruding flap, where the flap of each element protrudes in a direction opposite the other and wherein each flap is influenced by the user, when said elements (2*a*–2*c*) are arranged in the first gathered position (FIG. 3) as superjacently arranged layers, to spread the elements (2*a*–2*c*) somewhat apart for facilitating the final spreading to the user position.

4. The device as stated in claim 1, characterized in that each of the plate-shaped elements (2*a*–2*c*) are provided with at least one supporting means (5*a*–5*c*).

5. The device as claimed in claim 6, characterized in that each of the plate-shaped elements (2*a*–2*c*) are provided with at least one substantially circular recess (5*a*–5*c*) for supporting articles having inclined outer wall portions.

6. The device as claimed in claim 5, characterized in that each plate-shaped element (2*a*–2*c*) is provided with one or more recesses of various dimension (5*a*–9*a*), for supporting one or more articles of various sizes.

7. The device as claimed in claim 1, characterized in that each of the plate-shaped elements (2*a*–2*c*) is provided with at least one substantially circular recess (5*a*–5*c*) for supporting articles having inclined outer wall portions.

8. The device as claimed in claim 1, characterized in that each plate-shaped element (2*a*–2*c*) is provided with one or more recesses of various dimension (5*a*–9*a*), for supporting one or more articles of various sizes.

9. The device as stated in claim 2, characterized in that the attachment means (4) is pivotable and provided with means (8*a*–8*b*) for fixing its position in at least one selected pivot position, for setting the device (1) in various angular positions, with respect to an attachment base.

10. The device as claimed in claim 2, characterized in that each of the plate-shaped elements (2*a*–2*c*) is provided with at least one substantially circular recess (5*a*–5*c*) for supporting articles having inclined outer wall portions.

11. The device as claimed in claim 2, characterized in that each plate-shaped element (2*a*–2*c*) is provided with one or more recesses of various dimension (5*a*–9*a*), for supporting one or more articles of various sizes.

12. The device as stated in claim 1 wherein the plate-shaped elements are selectively configured for holding mutes for a musical instrument.

13. The device as stated in claim 5, characterized in that each of the plate shaped elements (2*a*–2*c*) is provided with at least one supporting means (5*a*–5*c*).

14. The device as claimed in claim 5, characterized in that each of the plate-shaped elements (2*a*–2*c*) is provided with at least one substantially circular recess (5*a*–5*c*) for supporting articles having inclined outer wall portions.

15. The device as claimed in claim 5, characterized in that each plate-shaped element (2*a*–2*c*) is provided with one or more recesses of various dimensions (5*a*–9*a*), for supporting one or more articles of various sizes.

16. A device for supporting articles, comprising a plurality of thin, plate-shaped elements (2*a*–2*c*) having a common pivoting zone (3) for selective rotation between a first gathered position which constitutes superjacent layers (FIG. 2) and a second, unfolded position (FIG. 1) which constitutes a plurality of article supporting elements (2*a*–2*c*), characterized in that the thin, plate-shaped elements (2*a*–2*c*) are provided with flat surfaces and are permanently attached at said common pivoting zone (3), and that the device comprises an attachment means (4) which can be pivoted relative the pivoting zone (3) and is detachable for adaption to attachment bases having various shapes and sizes.

17. The device as stated in claim 16, characterized in that it is provided with three flat plate-shaped elements (2*a*–2*c*), each being provided with a narrow neck portion (7*a*–7*c*) in the area of the pivoting zone (3), a first end of said neck portion (7*a*–7*c*) on each of the three elements extends to a supporting means (5*a*–5*c*) which is adapted to support an article, and a second end of said neck portion (7*a*–7*c*) being appropriately connected with the attachment means (4).

18. The device as claimed in claim 16, characterized in that the uppermost (2*a*) and the lowermost (2*c*) elements are each provided with a neck portion (7*a*–7*c*) which has, at an end proximate the pivoting zone, a protruding flap, where the flap of each element protrudes in a direction opposite the other, and wherein each flap is influenced by the user, when said elements (2*a*–2*c*) are arranged in the first gathered position (FIG. 3) as superjacently arranged layers, to spread the elements (2*a*–2*c*) somewhat apart for facilitating the final spreading to the user position.

19. The device as stated in claim 16, characterized in that the attachment means (4) is pivotable and provided with means (8*a*–8*b*) for fixing its position in at least one selected position, for setting the device (1) in various angular positions, with respect to an attachment base.

20. The device as stated in claim 16, wherein the plate-shaped elements are selectively configured for holding mutes for a musical instrument.

* * * * *

UNITED STATES PATENT AND TRADEMARK OFFICE

CERTIFICATE OF CORRECTION

PATENT NO. : 6,164,464
DATED : December 26, 2000
INVENTOR(S) : Trond Auke

It is certified that error appears in the above-identified patent and that said Letters Patent is hereby corrected as shown below:

Claim 5,
Line 1, delete "6" and insert -- 4 --.

Claim13,
Line 1, delete "5" and insert -- 12 --.

Claim 14,
Line 1, delete "5" and insert -- 12 --.

Claim 15,
Line 1, delete "5" and insert -- 12 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*